US008509636B2

(12) United States Patent
Akita

(10) Patent No.: US 8,509,636 B2
(45) Date of Patent: Aug. 13, 2013

(54) IMAGE FORMING APPARATUS

(75) Inventor: Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 314 days.

(21) Appl. No.: 12/949,162

(22) Filed: Nov. 18, 2010

(65) Prior Publication Data

US 2011/0123209 A1 May 26, 2011

(30) Foreign Application Priority Data

Nov. 24, 2009 (JP) ..... 2009-266650

(51) Int. Cl.
*G03G 15/00* (2006.01)

(52) U.S. Cl.
USPC ..... 399/43

(58) Field of Classification Search
USPC ..... 399/49, 72, 43
See application file for complete search history.

(56) References Cited

U.S. PATENT DOCUMENTS

| | | | | |
|---|---|---|---|---|
| 7,151,902 | B2 * | 12/2006 | Rakov et al. | 399/66 |
| 7,583,906 | B2 * | 9/2009 | Bessho | 399/30 |
| 8,095,032 | B2 * | 1/2012 | Torimaru et al. | 399/101 |

FOREIGN PATENT DOCUMENTS

| | | | |
|---|---|---|---|
| JP | 63-58374 | A | 3/1988 |
| JP | 2003-207949 | A | 7/2003 |
| JP | 2003-228201 | A | 8/2003 |

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image forming apparatus includes a color image forming portion for forming a color toner image on an image bearing member and a transparent image forming portion for forming a transparent toner image on the image bearing member. The color and transparent image forming portions form test color and test transparent toner images on the image bearing member. A detecting portion detects a density of each of the test color and test transparent toner images and a control portion controls an image forming condition for an image to be formed on a recording material, on the basis of a result of the detection. The test transparent and test color toner images are formed on the image bearing member between operations for forming the images on the recording material. A frequency of formations of the test transparent toner images is lower than that of the formations of the test color toner images.

3 Claims, 15 Drawing Sheets

(a)

(b)

(a)

(b)

IMAGE FORMING APPARATUS

FIELD OF THE INVENTION AND RELATED ART

The present invention relates to an image forming apparatus utilizing an electrophotographic process, such as a copying machine, a facsimile machine, a printer, or a multi-function machine of these machines.

In recent years, an image forming apparatus for forming an image with color toners of yellow, magenta, cyan, black and the like and for adjusting gloss of the image with transparent toner (clear toner) has been proposed. By using the transparent toner, it is possible to output a silver halide photograph-like image increased in gloss at a whole surface of a photographic original such as human figures or scenic shots or to output a so-called water mark with transparent toner locally formed on a recording material. For example, Japanese Laid-Open Patent Application (JP-A) Sho 63-58374 discloses a method in which a transparent toner image is formed in an area (non-image portion) in which a color toner image is not formed to make uniform the gloss at the whole surface of a print to be outputted.

It has been conventionally known that an outputted full-color image varies in color when an amount per unit of each of color toners is deviated from a target value. For that reason, various devices have been made in order to stabilize a density of each of the color toner images. For example, JP-A 2003-228201 discloses a method in which a test toner image (toner patch) is formed and then an image forming condition is periodically adjusted on the basis of a result of detection of the density of the patch by a density sensor.

Incidentally, the toner used for forming the patch is, after being subjected to the detection of its density by the density sensor, removed and collected by a cleaning means and then is accommodated in a residual toner container.

Here, it would be considered that similarly as in the case of the color toner, also with respect to the transparent toner, the patch is formed to stabilize the density. However, when the transparent toner patch is formed with the same frequency as that for the color toner patches in the image forming apparatus using the color toners and the transparent toner, a lowering in productivity and an increase in amount of the residual toner are caused.

SUMMARY OF THE INVENTION

A principal object of the present invention is to provide an image forming apparatus, in which an image is formed with color toners and a transparent toner, capable of suppressing a lowering in productivity due to formation of a patch and suppressing an increase in toner consumption amount while stabilizing a density of the image.

According to an aspect of the present invention, there is provided an image forming apparatus comprising:

color image forming means for forming a color toner image on an image bearing member;

transparent image forming means for forming a transparent toner image on the image bearing member, wherein the color image forming means is capable of forming a test color toner image on the image bearing member, and the transparent image forming means is capable of forming a test transparent toner image on the image bearing member;

detecting means for detecting a density of each of the test color toner image and the test transparent toner image which are formed on the image bearing member; and control means for controlling an image forming condition for an image to be formed on a recording material, on the basis of a result of detection of the density of each of the test color toner image and the transparent toner image which are formed on the image bearing member, wherein the test transparent toner image and the test color toner image are formed on the image bearing member by the transparent image forming means and the color image forming means between an operation for forming the image to be formed on the recording material and a subsequent operation for forming the image to be formed on the recording material, in which a frequency of formations of the test transparent toner images is lower than that of the formations of the test color toner images.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The image forming apparatus according to the present invention will be described below with reference to the drawings.

Embodiment 1

1. General Structure and Operation of Image Forming Apparatus

Figure 1:
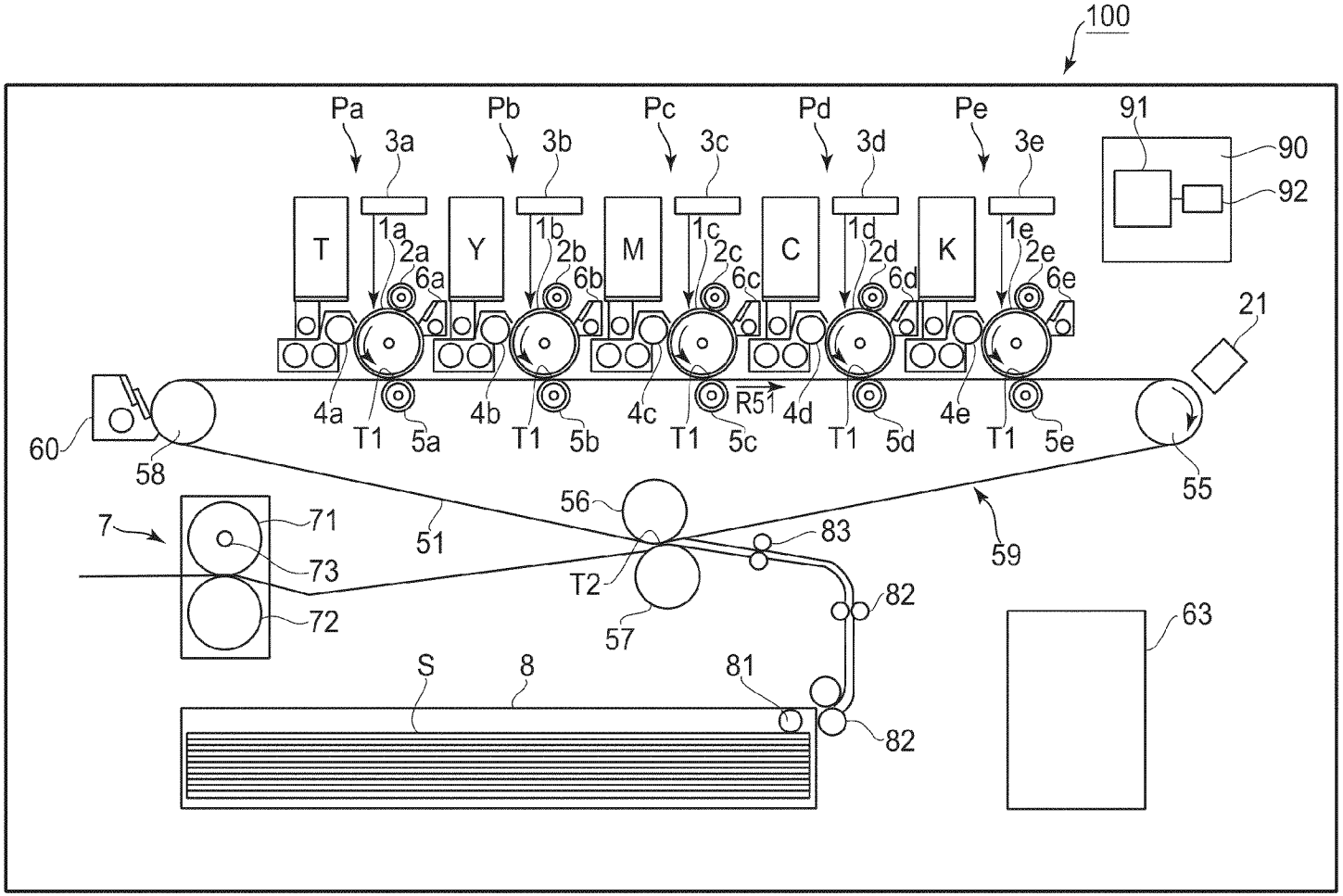
FIG. 1 is a schematic view for illustrating a structure of an image forming apparatus.

FIG. 1 is a schematic sectional view for illustrating a structure of an image forming apparatus 100 in this embodiment. The image forming apparatus 100 is an electrophotographic color image forming apparatus including an intermediary transfer belt 51 as an intermediary transfer member. A main assembly of the image forming apparatus 100 includes first to fifth image forming portions Pa, Pb, Pc, Pd and Pe for five colors as image forming means. The first to fifth image forming portions Pa, Pb, Pc, Pd and Pe are successively disposed from an upstream side to a downstream side along a rotational movement direction of the intermediary transfer belt 51 indicated by an arrow R51 in FIG. 1.

In this embodiment, the first to fifth image forming portions Pa to Pe are configured to form toner images of transparent (T) (or clear), yellow (Y), magenta (M), cyan (C) and black (K), respectively. The first image forming portion Pa constitutes a transparent toner image forming means for forming the toner image with transparent toner on the intermediary transfer belt 51. The second to fifth image forming portions Pb to Pe constitute color toner image forming means for forming color toner images with color toners on the intermediary transfer belt 51.

Incidentally, in this embodiment, basic constitutions and operations of the respective image forming portions Pa to Pe are substantially identical to each other except that the colors of the toners used are different from each other. Therefore, in the case where there is no need to particularly discriminate the image forming portions and their constituent elements, suffixes a, b, c, d and e added to represent the elements for the respective colors in FIG. 1 will be omitted from the following description and will be collectively described irrespective of the colors.

The image forming portion P includes a drum-like electrophotographic photosensitive member as a first image bearing member, i.e., a photosensitive drum 1. To the photosensitive drum 1, rotational power is transmitted from a driving source (not shown), so that the photosensitive drum 1 is rotationally driven at a pre-set process speed (peripheral speed).

At a periphery of the photosensitive drum 1, the following process devices (equipment) are disposed. That is, a charging roller 2 as a charging means, an exposure device 3 as an exposure means, a developing device 4 as a developing means, a primary transfer roller 5 as a primary transfer means (member), and a cleaning device 6 as a cleaning means are disposed. These devices are disposed in the order described above along the rotational direction of the photosensitive drum 1.

Figure 2:
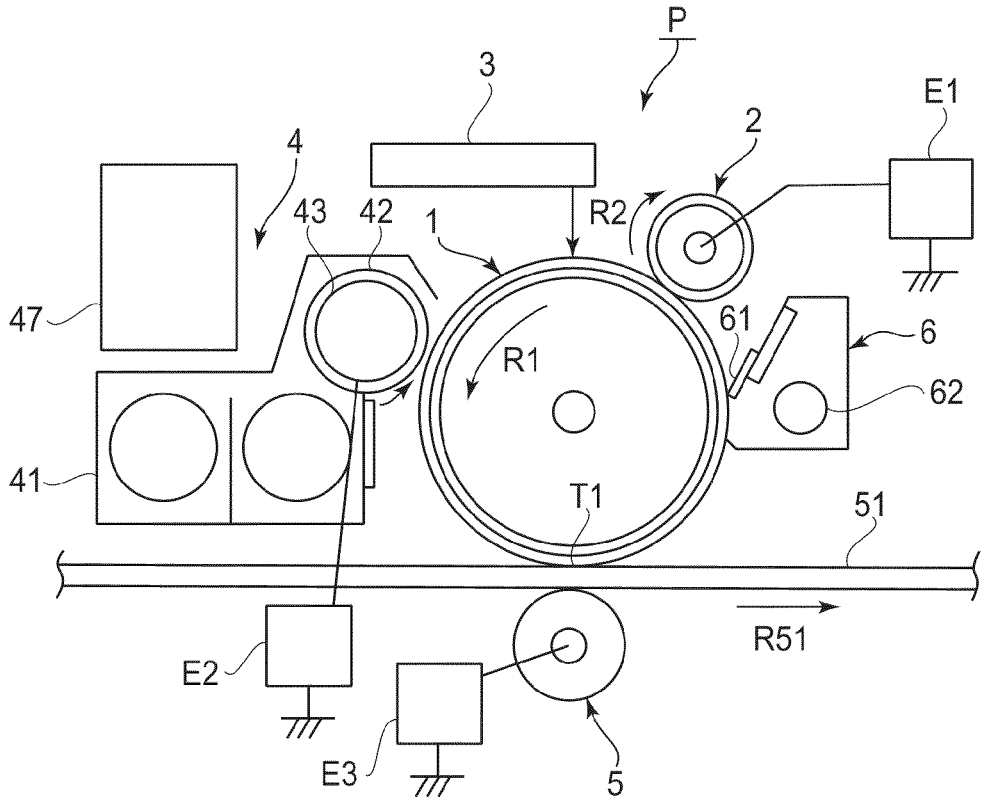
FIG. 2 is a schematic view for illustrating a structure of an image forming portion.

Referring to FIG. 2, the image forming portion P includes the photosensitive drum 1 which is shaft-supported rotatably. The photosensitive drum 1 as the image bearing member is a cylindrical photosensitive member of an organic photoconductor (OPC) and is rotationally driven in a counterclockwise direction indicated by an arrow R1 in FIG. 2 at a pre-set process speed (peripheral speed).

The charging roller 2 as the charging means is disposed so as to be contacted to the surface of the photosensitive drum 1. The charging roller 2 is urged against the photosensitive drum 1 with a proper urging force, by which the charging roller 2 is rotated in a direction indicated by an arrow R2 in FIG. 2 by the rotation of the photosensitive drum 1 in the arrow R1 direction. A predetermined charging bias voltage is applied from a power source E1 to the charging roller 2, so that the surface of the photosensitive drum 1 is uniformly charged to a predetermined polarity and a predetermined potential.

On a downstream side of the charging roller 2 with respect to the rotational direction of the photosensitive drum 1, the exposure device 3 is disposed. The exposure device 3 subjects the charged surface of the photosensitive drum 1 to scanning exposure to light while turning off and on laser light on the basis of image information. As a result, electric charge on the photosensitive drum 1 at an exposed portion is removed, so that an electrostatic latent image (electrostatic image) depending on the image information is formed.

On the downstream side of the exposure device 3 with respect to the rotational direction of the photosensitive drum 1, the developing device 4 is disposed. The developing device 4 includes a developer container 41 in which a two component developer containing toner (non-magnetic toner) and a carrier (magnetic carrier) is stored. At an opening of the developing container 41 facing the photosensitive drum 1, a developing sleeve 42 as a developer carrying member is rotatably provided. Above the developing device 4, a supply chamber 47 which contains the toner to be supplied is provided. The developer carried on the developing sleeve 42 and conveyed into a developing area in which the developer opposes the photosensitive drum 1 is erected by a magnetic force of a magnet roller 43 disposed inside the developing sleeve 42, so that a magnetic brush of the developer is formed. The magnetic brush rubs against the surface of the photosensitive drum 1 and a developing bias voltage is applied from a power source E2 to the developing sleeve 42. As a result, the electrostatic latent image is developed with the toner at the exposed portion, so that a toner image is formed on the photosensitive drum 1. As the developing bias voltage, an AC voltage in the form of a DC voltage biased with an AC voltage is applied.

On the downstream side of the developing device 4 with respect to the rotational direction of the photosensitive drum 1, the primary transfer roller 5 is disposed. The primary transfer roller 5 is urged against the photosensitive drum 1. As a result, the primary transfer roller 5 press-contacts the intermediary transfer belt 51 toward the surface of the photosensitive drum 1 with a predetermined urging force, so that a primary transfer portion (primary transfer nip) T1 is formed between the photosensitive drum 1 and the intermediary transfer belt 51. At the primary transfer portion T1, the intermediary transfer belt 51 is nipped between the photosensitive drum 1 and the primary transfer roller 5. By a power source E3, a transfer bias voltage of an opposite polarity to the toner charge polarity is applied to the primary transfer roller 5, so that the toner image is (primary-)transferred from the photosensitive drum 1 onto the surface of the intermediary transfer belt 51.

On the photosensitive drum 1 from which the toner image is transferred, untransferred toner (transfer residual toner) deposited on the surface of the photosensitive drum 1 is removed by the cleaning device 6. The cleaning device 6 includes a cleaner blade 61 and a conveying screw 62. The cleaner blade 61 contacts the photosensitive drum 1 and collects the transfer residual toner or the like remaining on the surface of the photosensitive drum 1. The collected transfer residual toner or the like is discharged by the conveying screw 62 to be accommodated in the residual toner container 63 which is a residual toner accommodating portion. In this embodiment, the transfer residual toner discharged from the respective image forming portions Pa to Pe and the transfer residual toner discharged from a belt cleaner described later are conveyed through conveying paths (not shown) and accommodated in a single residual toner container 63. In the case where the residual toner container 63 becomes full, the residual toner container 63 is exchanged or cleaned by a maintenance operator or a user.

In FIG. 1, under the photosensitive drums 1*a* to 1*e* of the image forming portions Pa to Pe, an intermediary transfer unit 59 is disposed. The intermediary transfer unit 59 includes the intermediary transfer belt 51 which is an endless belt-like intermediary transfer member as a second image bearing member. Further, the intermediary transfer unit 59 includes, as supporting rollers around which the intermediary transfer belt 51 is extended, a driving roller 55, a follower roller 58 and secondary transfer opposite roller 56. Further, the primary transfer rollers 5*a* to 5*e* are also included in the intermediary transfer unit 59. The intermediary transfer unit 59 further includes a secondary transfer roller 57 as a secondary transfer means (member) and the belt cleaner 60 as an intermediary transfer member cleaning means. The intermediary transfer belt 51 is nipped between the secondary transfer opposite roller 56 and the secondary transfer roller 57, so that a secondary transfer portion (secondary transfer nip) T2 is formed between the secondary transfer roller 57 and the intermediary transfer belt 51.

Incidentally, the intermediary transfer belt 51 is constituted by a dielectric resin material such as polycarbonate (PC), polyethylene terephthalate (PET), polyvinylidene fluoride (PVDF) or polyimide (PI). In this embodiment, PI resin having a volume resistivity of 108.5 Ω·cm (measured by using a probe in accordance with JIS-K 6911 method under a condition including an applied voltage of 100 V, an application time of 60 sec, a temperature of 23° C. and a humidity of 50% RH) and having a thickness t of 100 μm, but the intermediary transfer belt 51 may also be formed of other materials and different volume resistivity and thickness.

For example, when a full-color image using the transparent toner and the color toners (of Y, M, C and K) is formed, the toner images of the respective colors are formed on the photosensitive drums 1*a* to 1*e* of the image forming portions Pa to Pe, respectively. The respective color toner images formed on the photosensitive drums 1*a* to 1*e* are supplied with a transfer bias from the opposing primary transfer rollers 5*a* to 5*e* with respect to the intermediary transfer belt 51 at the respective primary transfer portions T1. As a result, the respective color toner images are successively transferred (primary-transferred) onto the intermediary transfer belt 51 and then are conveyed to the secondary transfer portion T2 by the rotation of the intermediary transfer belt 51 in the arrow R51 direction in FIG. 1. On the other hand, until this time, a recording material (transfer material) S such as recording paper stacked in a sheet feeding cassette 8 is conveyed to the secondary transfer portion T2. The recording material S is fed by a sheet feeding roller 81 and is then fed to registration rollers 83 by conveying rollers 82. The recording material S is then supplied to the secondary transfer portion T2 by the registration rollers 83 while being timed to the toner images on the intermediary transfer belt 51. At the secondary transfer portion T2, by the secondary transfer bias applied between the secondary transfer roller 57 and the secondary transfer opposite roller 56, the toner images are collectively transferred (secondary-transferred) onto the surface of the recording material S. The toner (secondary transfer residual toner) or the like remaining on the intermediary transfer belt 51 without being transferred onto the recording material S is removed by the belt cleaner 60 and is collected in the residual toner container 63.

The recording material S on which the toner images are transferred is conveyed into a fixing device 7 as a fixing means. The fixing device 7 includes a rotatable fixing roller 71, a pressing roller rotating in contact with the fixing roller 71, and a heater 73 provided inside the fixing roller 71. The recording material S is pressed and heated when the recording material S passes between the fixing roller 71 and the pressing roller 72, so that an unfixed toner image on the surface of the recording material S is melted and fixed. Thus, on the recording material S, the full-color image is formed.

Incidentally, the image forming apparatus 100 performs the scanning exposure of an original placed on an original supporting platen glass at a reader portion (not shown) and converts original information into an electric signal by a CCD and then effects A/D conversion, so that the electric signal is converted into a digital signal. Alternatively, to the image forming apparatus 100, the original information which has been data-outputted as the digital signal from a computer terminal is sent. Then, the image forming apparatus 100 processes the data as the digital signal at an image processing block to color-convert RGB signals into signals of Y, M, C and K and thereafter performs gamma correction and conversion process using reference table for toner (hereinafter referred to as look-up table (LUT)). The image forming apparatus 100 finally executes binarization. The binary-converted image data is, as an image memory, subjected to D/A conversion and is then transferred to an exposure driver. Then, the image forming apparatus 100 drives the exposure device 3 to effect image formation.

Figure 7:
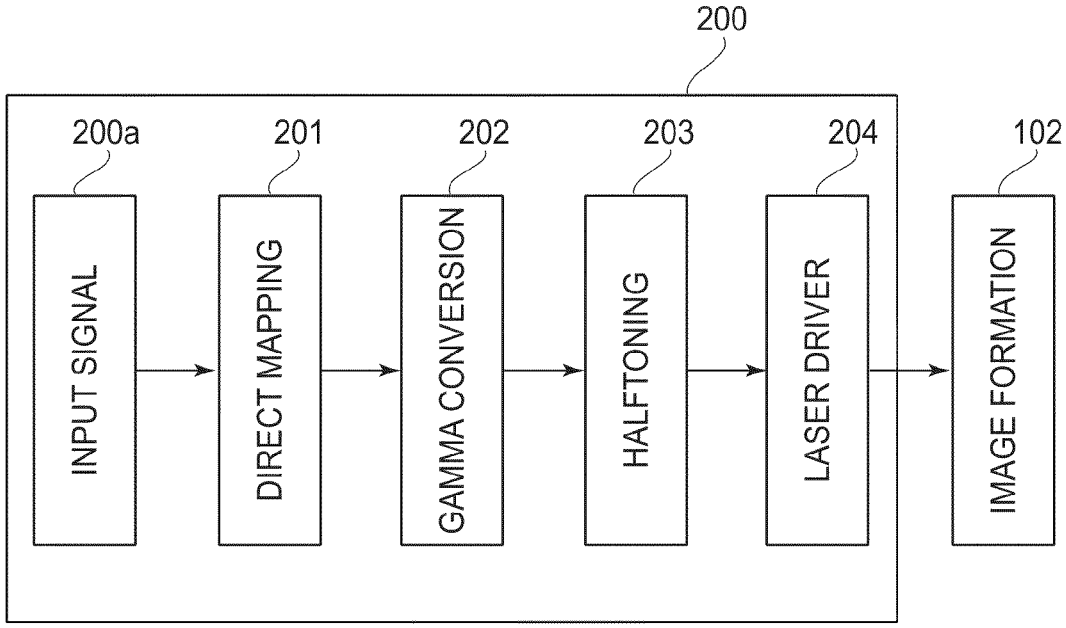
FIG. 7 is a block diagram showing an operation of an image processing portion.

A block diagram of an image processing portion 200 of the image forming apparatus 100 in this embodiment is shown in FIG. 7. In this embodiment, the image processing portion 200 is provided at a control portion 90 as a control means of the apparatus main assembly. To the image processing portion 200, as an input signal 200*a*, an image signal is sent from the reader portion or is externally sent after being read on unshown network. The image processing portion 200 may be provided at the reader portion or a printer portion. The input signal 200*a* is color-separated into 4 color components of Y, M, C and K at a direct mapping color conversion processing portion 201. The resultant image data is subjected to signal conversion corresponding to image density at a gamma conversion processing portion 202 and then is subjected to halftoning at a halftone processing portion 203. Thereafter, image exposure is effected at a printer portion through a laser driver 204 for driving the exposure device (laser exposure optical system) 3 as a latent image forming means at the printer portion, so that the image formation is started.

In this embodiment, at the second to fifth image forming portions Pb to Pe using the color toners, when the toner amount per unit area on the recording material S is 0.5 mg/cm$^2$, an optical density is set at 1.6 after the fixation. Further, the toner amount per unit area of the image to be formed at the first image forming portion Pa using the transparent toner is also set at a value which is almost equal to that at the second to fifth image forming portions Pb to Pe.

2. Patch Toner Image

Formation and detection of a patch toner image which is a test toner image (reference image or image for control) will be described.

With respect to the first to fifth image forming portions Pa to Pe, conditions for charging, exposure, development and transfer are set. In that state, a CPU 91 as a control means provided in the control portion 90 provided in the apparatus main assembly forms the patch toner image by reading a density pattern data stored in an ROM 92 as a storing means provided in the image forming apparatus 100. In this embodiment, as shown in FIG. 3(*a*), a patch toner image T is primary-transferred from each of the photosensitive drums 1*a* to 1*e* of the image forming portions Pa to Pe onto the intermediary transfer belt 51.

As an image density detecting means, a density sensor 21 is disposed opposed to the intermediary transfer belt 51 on the downstream side of the primary transfer portion T1 of the fifth image forming portion Pe and on the upstream side of the secondary transfer portion T2 with respect to a conveyance direction of the intermediary transfer belt 51 (the arrow R51 direction indicated in FIG. 1). By this density sensor 21, a density level of the patch toner image T on the intermediary transfer belt 51 is detected.

Figure 3:
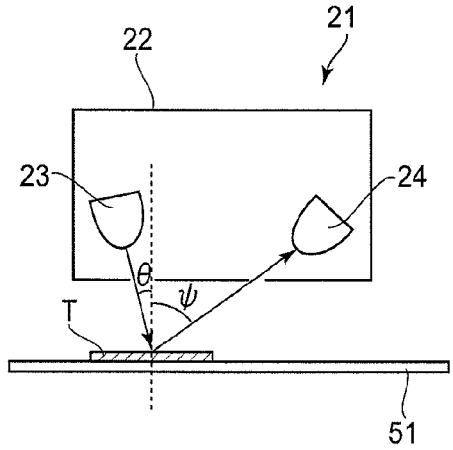
FIG. 3(*a*) is a schematic view for illustrating a constitution of a diffused light type density sensor, and FIG. 3(*b*) is a graph showing a relationship between a toner amount per unit area and an output of the density sensor.
Figure 3:
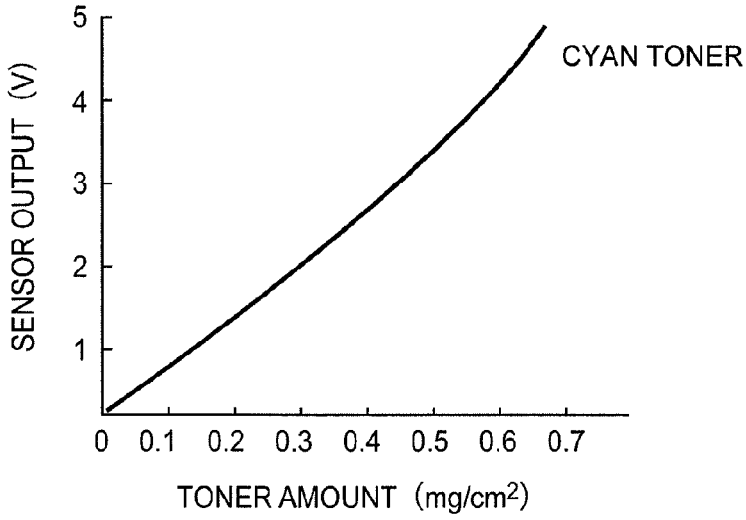

As shown in FIG. 3(*a*), the density sensor 21 is prepared by incorporating a light emitting element 23 such as an LED and a light receiving element 24 such as a photo-diode or CdS into a holder 22. The density sensor 21 measures the density of the patch toner image T by irradiating the patch toner image T on the intermediary transfer belt 51 with light from the light emitting element and then receiving diffused light from the patch toner image T by the light receiving element 24. Generally, reflected light obtained when the light is emitted includes specularly reflected light and diffused light. In this embodiment, the density sensor 21 used was of a diffused light type in which an incident angle θ was 15 degrees and a reflection angle ϕ was 45 degrees. FIG. 3(*b*) is a graph showing a relationship between the toner amount per unit area and an output of the density sensor 21 with respect to the cyan toner as an example.

Incidentally, also with respect to the transparent toner, a substantially similar detection result of the diffused light is obtained by the density sensor 21. That is, in the above-described manner, it is also possible to detect the patch toner image T with respect to the transparent toner.

Herein, the density is detected by the density sensor 21 and has the same meaning as the toner amount per unit area ($mg/cm^2$), thus being different from an image density (reflection density/transmission density) of the toner image fixed on the recording material S. For that reason, as the density sensor 21, a toner height sensor for measuring the toner amount per unit area ($mg/cm^2$) may also be used. Hereinafter, for convenience of explanation, the density of the patch toner image T detected by the density sensor 21 is referred to as a "patch density", and the image density of the toner image fixed on the recording material S is referred to as a "final image density".

3. Patch Density Control

Figure 4:
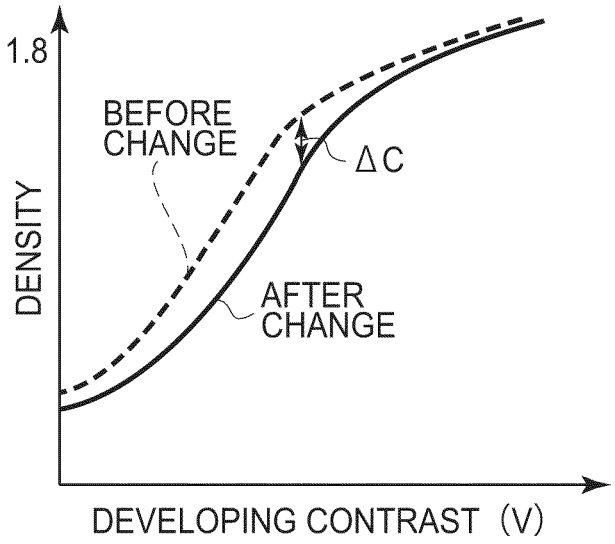
FIG. 4(*a*) is a graph showing a relationship between a developing contrast potential and a patch density, and FIG. 4(*b*) is a graph showing a relationship between the developing contrast potential and a patch density difference.
Figure 4:
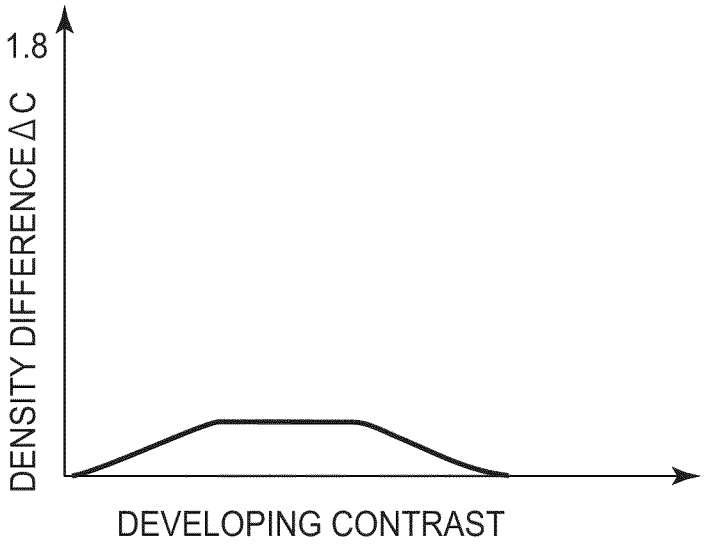

Patch density control effected on the basis of the detection result of the patch density will be described. First, a (gamma) characteristic including a developing contrast potential (a difference between a latent image potential and a DC component of the developing bias voltage) taken along an abscissa and the patch density as the output of the density sensor 21 taken along an ordinate is shown in FIG. 4(*a*).

This gamma characteristic is liable to vary depending on various factors and thus changes the toner amount per unit area, thus being liable to impair stability of the image. As an example, the case where the latent image potential is fluctuated by 20 V, i.e., the case where the developing contrast potential is accidentally increased by 20 V is assumed. In this case, as shown in FIG. 4(*a*), a curve representing the gamma characteristic is shifted upward. Specifically, in FIG. 4(*a*), the curve indicated by a solid line is shifted to a curve indicated by a broken line. This amount of change (shift) varies depending on the developing contrast potential. When a differential density ΔC between the density before the change and the density after the change is plotted with respect to the developing contrast potential, the resultant graph is as shown in FIG. 4(*b*). That is, the differential density between the densities before and after the change is moderately increased until a certain developing contrast potential and then is moderately decreased when the developing contrast potential is increased from the certain developing contrast potential.

The patch toner image T is formed on the intermediary transfer belt 51 through the respective steps of the latent image formation, the development and the transfer with timing other than during normal image formation in which a normal image forming process is executed. Then, the patch density is detected by the density sensor 51 and on the basis of its detection result, the patch density control for optimizing a density signal used for gamma conversion. That is, as the patch density control, control for correcting an LUT, which is a table for representing a relationship between the density signal and the patch density, included in the gamma conversion portion 202 of the image processing portion 200 provided in the image forming apparatus 100 is effected as shown in FIG. 7. In this embodiment, a gradation patch including a plurality of density portions from a low density portion to a high density portion is formed as the patch toner image T on the intermediary transfer belt 51 and the patch density of the gradation patch is detected by the density sensor 21, so that gradation control is effected.

The patch toner image T is formed more specifically in the following manner. That is, the image information on the basis of a test pattern (gradation patch pattern in this embodiment) stored in the ROM 92 as the storing means of the control portion 90 provided in the image forming apparatus 100 is subjected to signal processing and then is sent to the laser driver 204. In accordance with this image information, the exposure device (laser exposure optical system) 3 is driven, so that a latent patch image which is a latent image for image control (latent image for test toner image) is formed on the photosensitive drum 1. This latent patch image is developed by the developing device 4, so that the patch toner image is formed. Further, in this embodiment, the patch toner image T formed on the photosensitive drum 1 is transferred onto the intermediary transfer belt 51 and then is detected by the density sensor 21. In this embodiment, along a flow chart shown in FIG. 6(*a*), the LUT correction and the gradation control are effected. These correction and control are effected by the CPU 91 provided in the control portion 90 of the apparatus main assembly.

First, in a non-image forming area other than an image area in which the toner image is transferred onto the recording material S on the intermediary transfer belt 51, the patch toner image T is formed and then the patch density which is the toner amount (per unit area) is detected by the density sensor 21 (S101, S102). The non-image forming area includes a non-image area between an image portion on a single sheet of the recording material S on the photosensitive drum 1 and an image portion on a subsequent sheet of the recording material S when continuous image formation is effected on a plurality of sheets of the recording material S. Alternatively, in the case of the image formation on the single sheet of the recording material S, the non-image forming area includes a non-image area immediately after the image formation.

Then, the difference ΔC between an amount of detection of the patch density by the density sensor 21 and a target value is calculated (S103). On the basis of an amount of deviation of the detection amount from the target value, the LUT information at the gamma conversion portion 202 is corrected (S104), so that control for stably maintaining the density is effected.

Incidentally, in 5103, when the target value is determined in advance and the differential density ΔC from the target value is obtained, proper control can be effected depending on an environment of the image forming apparatus 100. Further, the control is not readily influenced by disturbance such as noise, so that it is possible to realize stabilization of color with high accuracy. However, the processing for obtaining the differential density ΔC is not always required to be performed. For example, the LUT may also be directly corrected from a relationship between the detection result and the density signal of the density sensor 21.

Incidentally, as the gamma characteristic changing factors, in addition to the latent image potential change, there are various factors such as changes in developing property and transfer property due to the change in toner charge amount. However, in many cases, the amount of the change is increased with the lapse of time. That is, in order to control the density with accuracy, it is desirable that an interval of the patch density control described above is decreased. However, compared with the conventional case where the image formation is effected by using the four color toners in general, there is a need to add an operation for reading the transparent toner image into a normal cycle in which the four color toner images are successively read, due to the addition of the transparent toner. As a result, a frequency at which the result of the patch toner images of the color toners is reflected is lowered.

4. Control of Patch Toner Image Formation

In this embodiment, control for changing the frequency of the patch density control with respect to the color toners and the transparent toner will be described.

One of the objects of the present invention is to suppress the number or frequency of formation of the patch toner image with the transparent toner in the image forming apparatus in which the image is formed with the toners of five colors including the transparent toner in addition to the four color toners. Further, as a result, alleviation of an occurrence of a down time (period in which image output cannot be performed due to an adjusting 0) which put a load on the user and of a change in color of the color toners is another one of the objects of the present invention. Further, another one of the objects of the present invention is to realize reduction in cost increased by toner consumption and to downsize the residual toner container by suppressing that the residual toner container becomes full early. Further, provision of the image forming apparatus which is excellent in maintenance property and is capable of forming a high-quality color image is also further one of the objects of the present invention.

In order to accomplish these objects, in this embodiment, the image forming apparatus 100 is operable in two types of modes as a mode in which the patch toner image T for the patch density control is formed, in which the frequency of formation of the patch toner image T with the transparent toner is less than the frequency of formation of the patch toner images with the color toners.

In this embodiment, as one mode in which the patch toner image T is formed, a mode in which the patch toner images T are formed with the four color toners of Y, M, C and K (hereinafter referred to as a "4-color patch mode") is set. Each of the respective color patch toner images is the gradation patch including the plurality of portions including the low density portion to the high density portion.

Further, in this embodiment, as the other mode in which the patch toner image T is formed, a mode in which the patch toner images T are formed with five toners consisting of the transparent toner of transparent (clear) and the four color toners of Y, M, C and K (hereinafter referred to as a "5-color patch mode") is set.

In this embodiment, as the density sensor 21 disposed opposed to the intermediary transfer belt 51, only one density sensor is disposed at a central portion with respect to a thrust direction (perpendicular to a conveyance or movement direction of the intermediary transfer belt). For that reason, each patch toner image T has a length of 20 mm with respect to the thrust direction and a length of 20 mm with respect to the conveyance direction. The portion patch toner images T for each of the colors (i.e., the gradation patches each including the plurality of portions) are successively formed along the conveyance direction.

Figure 5:
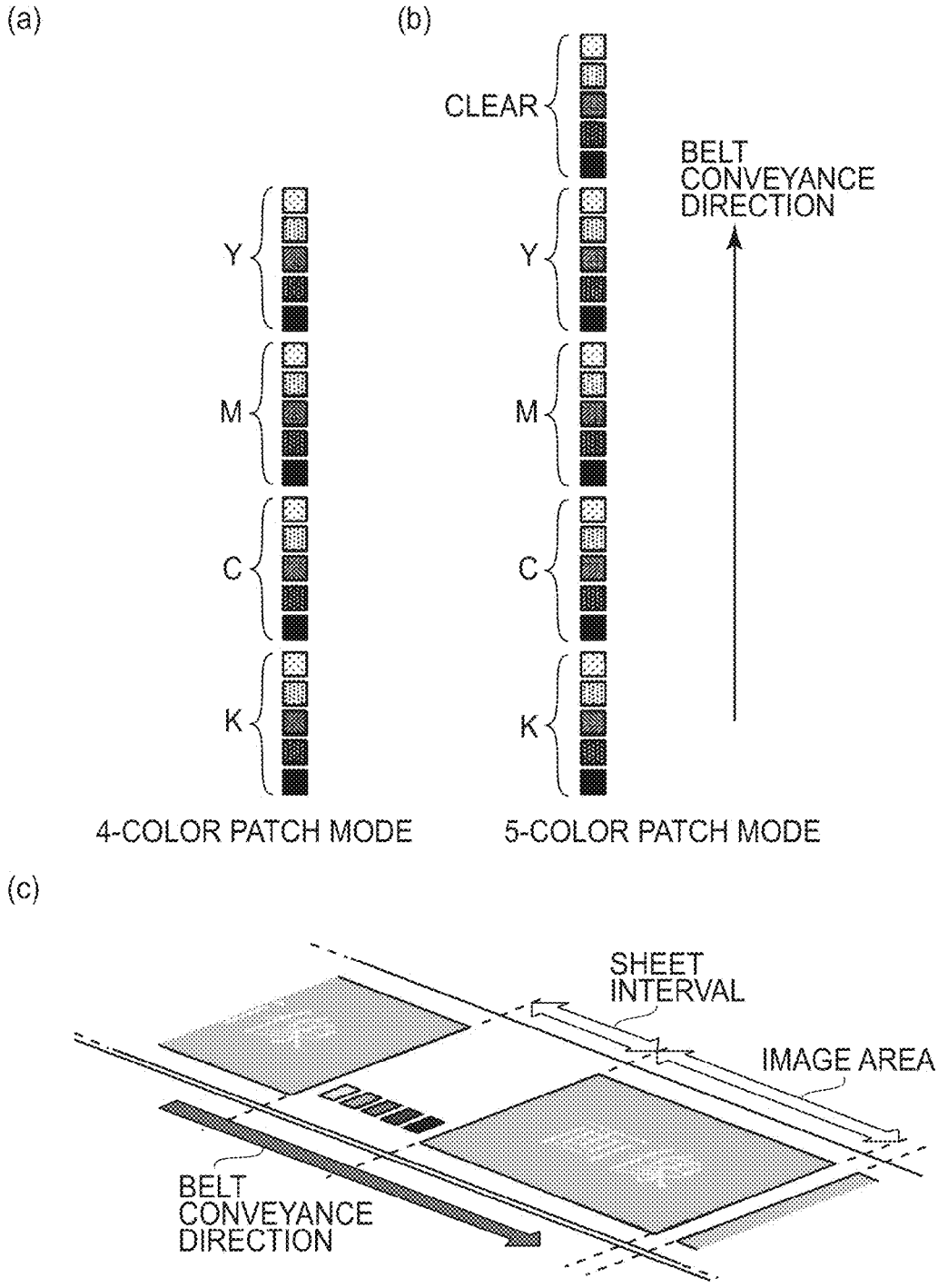
FIGS. 5(*a*) to 5(*c*) are schematic views each for illustrating an example of a patch toner image.

FIG. 5(*a*) shows the patch toner images T formed on the intermediary transfer belt 51 in the 4-color patch mode. In this embodiment, in one job (i.e., a series of image forming operations performed with respect to a single sheet of or a plurality of sheets of the recording material in accordance with one image formation start instruction), the 4-color patch mode is executed every 20 sheets of A4-sized paper.

On the other hand, FIG. 5(*b*) shows the patch toner images T formed on the intermediary transfer belt 51 in the 5-color patch mode. In this embodiment, in one job, the 5-color patch mode is executed every 40 sheets of A4-sized paper.

In summary, in this embodiment, in the case where the image formation is effected while operating all of the developing devices 4*a* to 4*e* for the five colors, every 20 sheets of A4-sized paper, the 4-color patch mode and the 5-color patch mode are repeated alternately.

Figure 6:
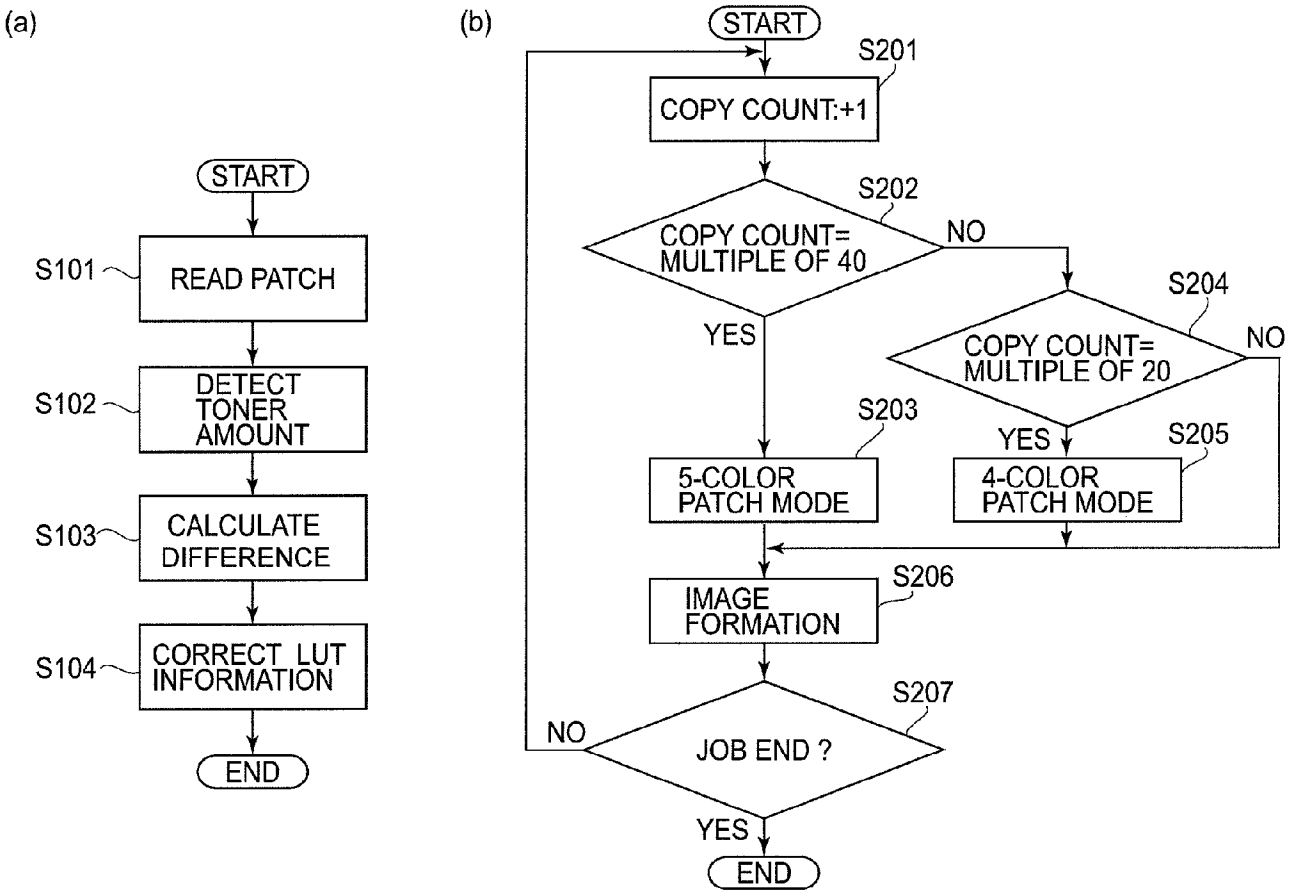
FIG. 6(*a*) is a flow chart for illustrating patch density control in the present invention, and FIG. 6(*b*) is a flow chart for illustrating a patch toner image forming operation.

FIG. 6(*b*) is an operation flow chart showing a procedure of formation of the patch toner images in this embodiment. Specifically, FIG. 6(*b*) is a flow chart regarding control of the frequency (timing) at which an adjusting toner image for adjusting the image forming condition is formed. The procedure of the patch toner image formation timing control will be described below.

The image formation using the five color toners (including the transparent toner) is started (S201) and the number of sheets subjected to the image formation is successively counted (S202). In the case where an integrated count value of the number of the sheets of the A4-sized paper (recording material S) is a multiple of 40 (YES of S203), the patch toner images T are formed in the 5-color patch mode (FIG. 5(*b*)) (S204). Further, in the case where the integrated count value is not the multiple of 40 (NO of S203) but is the multiple of 20 (YES of S204), the patch toner images T are formed in the 4-color patch mode (FIG. 5(*a*)) (S205). In the case where the integrated count value is not the multiple of 40 and is not the multiple of 20 (NO of S204), the procedure goes to subsequent image formation (S206).

As described above, in this embodiment, an operation for forming the test toner images for the image density control on the image bearing member is repeatedly performed between adjacent operations for forming an image for output by using the color toners and the transparent toner. At this time, the frequency of the formation of the test toner image with the transparent toner is less than that with the color toners.

In this embodiment, the patch image for adjusting the image forming condition is formed in a sheet interval area. FIG. 5(*c*) is a schematic view for illustrating the area in which the patch image for adjusting the image forming condition. In this embodiment, the patch image formed at each image forming portion is transferred onto the intermediary transfer belt. At this time, when the patch image for the adjustment is transferred onto the sheet, the image which is not intended by the user is outputted. For that reason, the patch image for adjusting the image forming condition is formed in the area (non-image portion) in which the toner image (picture image) to be transferred onto the sheet is not formed. Further, the patch image density may preferably be corrected on the basis of the density in the image forming area with respect to the longitudinal direction of the photosensitive member. The image forming apparatus in this embodiment detects the patch toner image formed in a so-called sheet interval area between the image area and a subsequent image area on the intermediary transfer belt.

According to the method of forming the patch toner image along the flow of the above-described operation in this embodiment, the following advantages can be obtained. With respect to the color toners of Y, M, C and K, the patch toner images T are formed every 20 sheets subjected to the image formation in one job and the detection result of the patch density thereof is reflected and fed back to the LUT for each color toner. On the other hand, with respect to the transparent toner, the patch toner images T are formed every 40 sheets subjected to the image formation in one job and the detection result of the patch density thereof is reflected and fed back to the LUT for the transparent toner. Thus, by lowering the frequency of the patch density control effected by forming the patch toner image with the transparent toner, a proportion of a time required for the patch density control with respect to the transparent toner image to a time required for the patch density control with respect to the toner images of all of the controls can be decreased. That is, the frequency of the patch density control of the color toners can be increased and therefore compared with the case where the patch density control is effected with the same frequency with respect to the toner images of all of the controls, the patch density of the color toners, i.e., the toner amount of the color toners can be controlled with high accuracy. Further, by lowering the frequency of the patch density control of the transparent toner, cost resulting from the toner consumption can be reduced.

Here, when an original object of the formation of the patch toner image T is to stabilize the density of the final image is taken into consideration, by the control for decreasing the frequency of the patch density control of the transparent toner as described above, it is assumed that the final image density with the transparent toner becomes unstable compared with that with the color toners. However, the transparent toner is originally used for achieving uniformity of gloss or partial change in gloss, thus being different in intended purpose from the color toners used for essentially reproducing the density of the final image. The transparent toner also has a feature such that a gloss characteristic change ratio with respect to the transparent toner amount is visually dull compared with the final image density change ratio with respect to the color toner amount.

Figure 8:
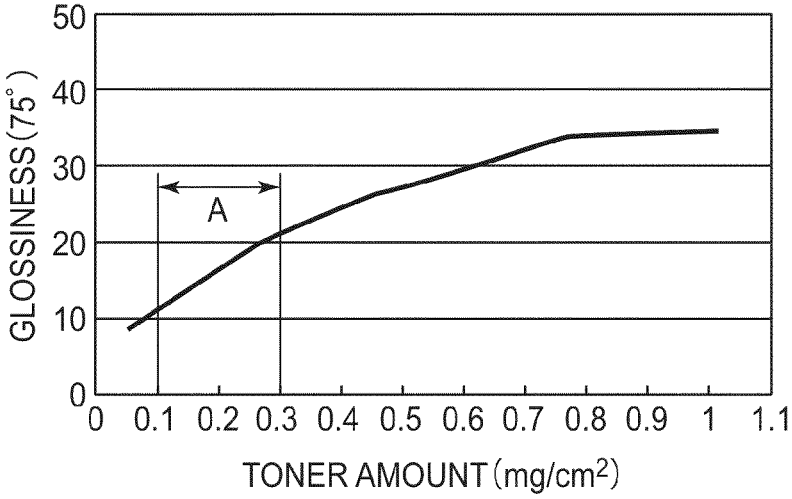
FIG. 8 is a graph showing a relationship between transparent toner amount per unit area and glossiness.

FIG. 8 is a typical example of a relationship between the glossiness and the weight (toner amount) of the transparent toner per unit area. The glossiness measurement value is obtained by 75°-reflection. As is apparent from FIG. 8, the relationship between the glossiness and the toner amount of the transparent toner shows a lowering in glossiness due to an unevenness of the recording material S when the toner amount is increased, thus showing a positive slope relationship in an area A indicated in the figure. For example, in an area of the toner amount from 0 mg/cm$^2$ to 0.5 mg/cm$^2$, with respect to a glossiness change of 5, a toner amount change is about 0.1 mg/cm$^2$ to about 0.2 mg/cm$^2$. Here, e.g., as described in JP-A 2003-207949, in view of the description that a substantially uniform glossiness is recognizable when the glossiness change is less than 5, the toner amount changes from about 0.1 mg/cm$^2$ to about 0.2 mg/cm$^2$.

On the other hand, in this embodiment, the color toners provide the final image density of 1.6 at the toner amount of 0.5 mg/cm$^2$. For example, in order to satisfy ΔE (color difference) ≦5 which is considered as a level which is of practically no problem at a halftone density of 0.4, there is a need to suppress the density difference of 0.1 or less. That is, the change is required to be suppressed within the density range of 0.35-0.45. This corresponds to the toner amount of about 0.03 mg/cm$^2$. Thus, it is understood that compared with the tolerable change range of the toner amount of the transparent toner with respect to the glossiness change, the tolerable change range of the toner amount of the color toners with respect to the final image density change of the color toners is very severe. For this reason, even when the frequency of the transparent toner patch density control is lowered compared with that of the color toners, the change in transparent toner amount is not readily recognized as the change in glossiness, so that the transparent toner patch image is sufficiently usable.

Incidentally, in this embodiment, brightness values and density values were measured by using a spectrodensitometer ("MODEL 528", mfd. by X-Rite Co., Ltd.). Further, values of L*a*b* were measured by using the spectrodensitometer ("MODEL 528") under a measurement condition of a measurement light source of D50 and a measurement viewing angle of 2°. Further, the glossiness values (projection and light receiving angles: 75°) were measured by a glossiness meter ("micro-TRI-gloss", mfd. by BYK-Gardner).

As described above, in the image forming apparatus 100 in this embodiment, during the full-color image formation, the frequency of formation of the patch toner images T with the transparent toner is made smaller than that of the patch toner images T with the color toners. As a result, a down time required for the reading operation of the patch toner images T can be reduced. Further, the patch density control frequency of the color toners can be increased relative to the transparent toner, so that it is possible to realize gradation reproduction of the color toners with minimum downtime and suppression of change in color during color mixing.

Further, the frequency of formation of the transparent toner patch toner images T is minimized, so that the residual toner can be minimized and thus it is possible to suppress a phenomenon that the residual toner container 63 becomes full early. For that reason, a maintenance operation can be omitted and stable image formation can be effected without impairing productivity. Further, a high-quality image with a uniform glossiness which is a principal object of using the transparent toner is not also impaired.

Embodiment 2

The image forming apparatus in this embodiment has the same basic constitution and operation as those in Embodiment 1. Therefore, constituent elements having the same or corresponding functions and constitutions as those in Embodiment 1 are represented by the same reference numerals or symbols and will be omitted from specific description.

In Embodiment 1, by decreasing the patch density control frequency of the transparent toner image compared with that of the color toner images, the problems such as the increase in downtime by the patch density control, the lowering in control accuracy with respect to the color toners and the increase in toner consumption amount were solved.

On the other hand, in this embodiment, with respect to the four color toners of Y, M, C and K, the same patch density control as in Embodiment 1 is executed. On the other hand, with respect to the transparent toner, by decreasing the number of the patch toner images T formed in one patch density control, the above-described problems are solved.

Further, with respect to the color toner images, the patch reproducibility in each image density area is required, so that the gradation patch including the plurality of density portions from the low density portion to the high density portion is formed as described in Embodiment 1. Typically, this gradation patch includes a portion halftone density portions different in density and a solid density portion (of a maximum density level). Similarly as in Embodiment 1, this gradation patch is formed on the photosensitive drum 1 and is transferred onto the intermediary transfer belt 51. Then, the density thereof is detected by the density sensor 21, so that the gradation control is effected.

On the other hand, the transparent toner is used for reproducing high-gloss image such as a photography original in many cases and therefore from the relationship between the glossiness and the toner amount per unit area of the transparent toner shown in FIG. 8, the toner amount area in which the transparent toner is used is limited to a high toner amount area.

Figure 9:
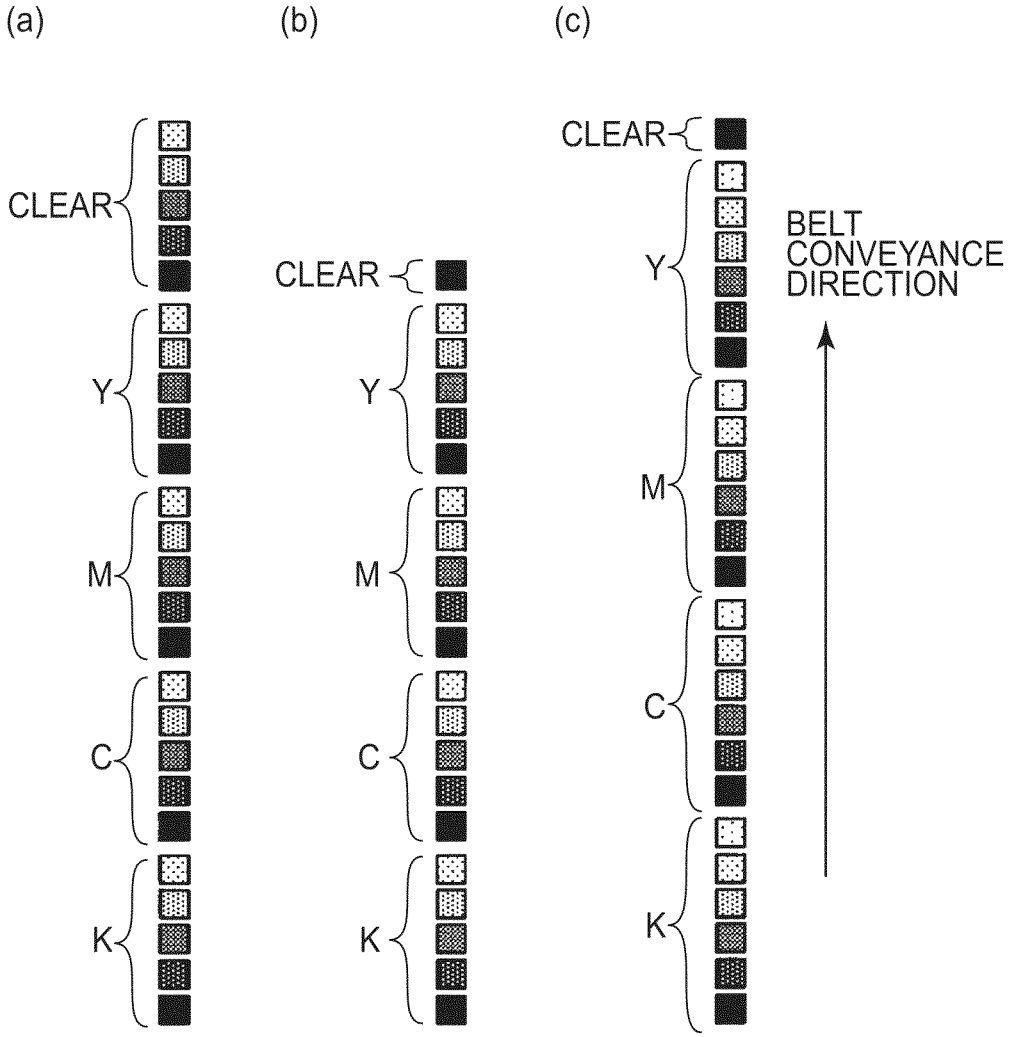
FIGS. 9(*a*) to 9(*c*) are schematic views each for illustrating another example of the patch toner image.

In this embodiment, five color patch toner images T as schematically shown in FIG. 9(*b*) are used. For comparison, five color patch toner images T having the same number with respect to the transparent toner (clear) and each of the color toners of Y, M, C and K are schematically shown in FIG. 9(*a*).

FIG. 9(*b*) shows the five patch toner images including four patch toner images of the color toners of Y, M, C and K each containing the plurality of portions similarly as in Embodiment 1 in the color toner patch density control and including the patch toner image of the transparent toner limited to the high density area in the transparent toner patch density control. Typically, the patch toner image with the transparent toner includes the high density area of the solid density portion (of the maximum density level) (includes only the solid density portion in this embodiment). As shown in FIG. 9(*b*), there is no patch portion other than the high density portion, compared with the case of FIG. 9(*a*), it is understood that the area required for the control, i.e., a control time is decreased.

Further, by utilizing a reduction time by the patch density control of the transparent toner, the number of the patch toner images corresponding to the plurality of portions of the color toner images is increased as shown in FIG. 9(*c*), so that it also becomes possible to effect high-definition gradation control.

As described above, in this embodiment, an operation for forming the test toner images with the color toners and the transparent toner for the image density control on the image bearing member is performed between adjacent operations for forming an image for output by using the color toners and the transparent toner. At this time, at least the test toner images with the color toners of the test toner images with the color toners and the transparent toner consists of the portion different density portions, and the number of the test toner image with the transparent toner is less than that with the color toners.

Incidentally, with respect to the transparent toner, the patch density is controlled only in the high density area, so that there is a possibility that the change in toner amount occurs in an area other than the high density area. However, as described in Embodiment 1, with respect to the transparent toner, the gloss characteristic change ratio to the toner amount is visually dull. For this reason, the transparent toner patch image is not readily recognized as the change in gloss and thus is sufficiently usable.

As described above, in the image forming apparatus 100 in this embodiment, during the full-color image formation, the number of the formed patch toner images T with the transparent toner is made smaller than that of the patch toner images T with the color toners. As a result, a down time required for the reading operation of the patch toner images T can be reduced. Further, the number of the formed patch toner images of the color toners can be increased relative to the transparent toner, so that it is possible to realize gradation reproduction of the color toners with minimum downtime and suppression of change in color during color mixing.

Further, the number of the formed transparent toner patch toner images T is minimized, so that the residual toner can be minimized and thus it is possible to suppress a phenomenon that the residual toner container 63 becomes full early. For that reason, a maintenance operation can be omitted and stable image formation can be effected without impairing productivity. Further, a high-quality image with a uniform glossiness which is a principal object of using the transparent toner is not also impaired. Incidentally, in Embodiments 1 and 2, the color image forming portions and the transparent image forming portion are provided a single image forming apparatus but may also be applied to an image forming system including a portion apparatuses.

Embodiment 3

In Embodiments 1 and 2, the (single) image forming apparatus including the image forming portions for forming the color toner images and the image forming portion for forming the transparent toner image is described. The present invention may also be applied to an image forming system including the image forming apparatus for forming the color toner images and the image forming apparatus for forming the transparent toner image.

A schematic constitution of the image forming system and a connection relationship between control portions of the image forming apparatuses will be described. Then, a particular problem when the image is formed by the plurality of image forming apparatuses will be described. Finally, in the case where the present invention is applied to the image forming system, a preferable patch image formation timing control will be described along a flow chart.

1. Image Forming System Constitution

The constitution in which the transparent image forming apparatus capable of forming the transparent toner image as a post-processing apparatus of the color image forming apparatus is connected to the color image forming apparatus is preferable in the following points. Specifically, the user who has already possessed the full-color image forming apparatus may only be required to make a less investment than the case where the user replaces the full-color image forming apparatus with a new apparatus (system) capable of forming the transparent toner image and the color toner images. Further, the transparent image forming apparatus can be connected to various full-color image forming apparatuses different in productivity, so that it is possible to provide a system which meets the user's needs.

An example of the image forming system will be described with reference to FIG. 10. Incidentally, a detailed constitution of an engine portion is substantially equal to that in Embodiment 1, thus being omitted from description.

Figure 10:
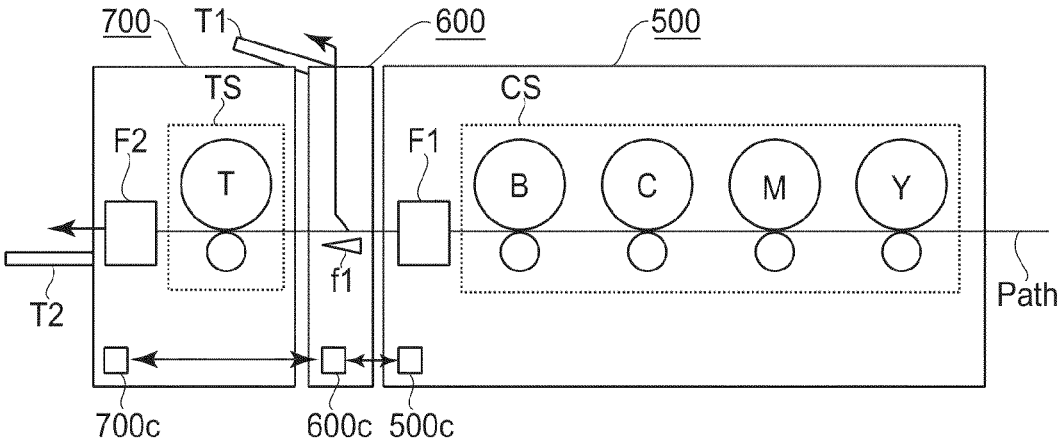
FIG. 10 is a schematic view for illustrating a constitution of an image forming system including image forming portions.

FIG. 10 is a schematic view for illustrating the schematic structure of the image forming system. The image forming system principally includes a color image forming apparatus 500 for forming the color toner images and a transparent image forming apparatus 700 for forming the transparent toner image on the sheet on which the color toner images have been fixed. The sheet conveyance from the color image forming apparatus 500 to that transparent image forming apparatus 700 is performed by a conveying device 600.

The color image forming apparatus 500 includes a color image forming portion CS for forming on the sheet the color toner images of Y, M, C and K. In this embodiment, as an example, a direct-transfer type image forming apparatus for directly transferring the toner images onto the sheet will be descried but the color image forming apparatus may also be of the intermediary transfer type described in Embodiments 1 and 2. In the direct-transfer type image forming apparatus, the patch images are formed on the photosensitive members for carrying the respective color toner images and are then detected by an optical sensor. The toner images formed at the color image forming portion CS are heated by a first heating device F1. The sheet on which the image is formed by the color image forming apparatus is delivered to the conveying device 600 connected to the color image forming apparatus on a downstream side.

The conveying device 600 includes a flapper f1. The flapper f1 switches whether the sheet on which the color image is fixed is discharged onto a sheet discharging tray T1 or delivered to the transparent image forming apparatus 700.

In the transparent image forming apparatus 700, the transparent toner image is formed on the sheet, delivered from the conveying device 600, at a transparent image forming portion TS. Then, the sheet on which the transparent toner image is formed is heated and fixed by a second heating device F2 and then is discharged onto a second sheet discharging tray T2.

The respective apparatuses 500 and 700 and the device 600 are connected so as to deliver the sheet and include control portions 500*a*, 700*a* and 600*a*, respectively for controlling the apparatuses and device so as to operate the apparatuses and device as the image forming system. The control portions 500*a*, 600*a* and 700*a* are connected through a network.

2. System Control Block Diagram

Figure 11:
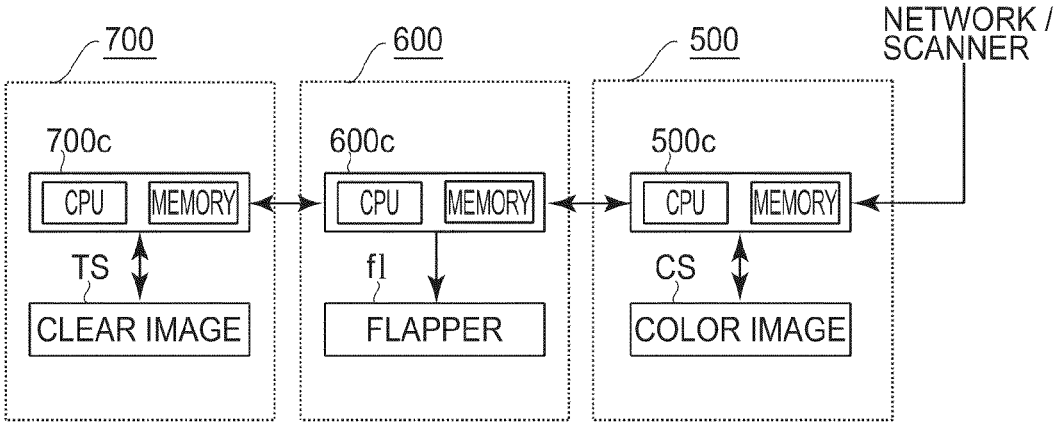
FIG. 11 is a block diagram for illustrating a connection relationship among controllers of the image forming apparatus.

A connection relationship between the control portions (controllers) of the apparatuses and device will be described with reference to FIG. 11. In this embodiment, the image forming apparatus includes the control portions for the respective apparatuses and device. When the control portions are connected, a main control portion for effecting centralized control of the respective apparatuses and device may be any one of the controllers 500*c*, 600*c* and 700*c* but in this embodiment, the control portion 500*c* provided in the color image forming apparatus 500 effects the centralized control of the system.

Each of the control portions includes a memory as a storing means. The control portion 500*c* of the color image forming apparatus 500 controls respective portions including the color image forming portion C. Similarly, the control portion 600*c* of the conveying device 600 controls respective portions including the flapper f1, and the control portion 700*c* of the transparent image forming apparatus 700 controls respective portions including the transparent image forming portion TS.

Further, the control portion 500*c* effects the centralized control of the control portions 600*c* and 700*c* and also effects the centralized control of the entire system by sending respective pieces of information through a network interface as a transfer means. Further, similarly as in Embodiment 1, the image forming system performs the image forming operation on the basis of image formation information inputted into the color image forming apparatus through the external network.

3. Image Forming Mode and Counting Method

The image forming system in this embodiment is operable in a mode in which the image is formed with only the color toners and a mode in which the image is formed with the color toners and the transparent toner. A counting method of the number of sheets subjected to the image formation in this embodiment will be described. In this image forming system consisting of the portion apparatuses and device, a counter for counting the number of sheets subjected to the image formation by the color image forming apparatus and a counter for counting the number of sheets subjected to the image formation by the transparent image forming apparatus are separately provided. Therefore, the counting method of the number of sheets subjected to the image formation in each of the modes will be described along a flow chart.

Figure 12:
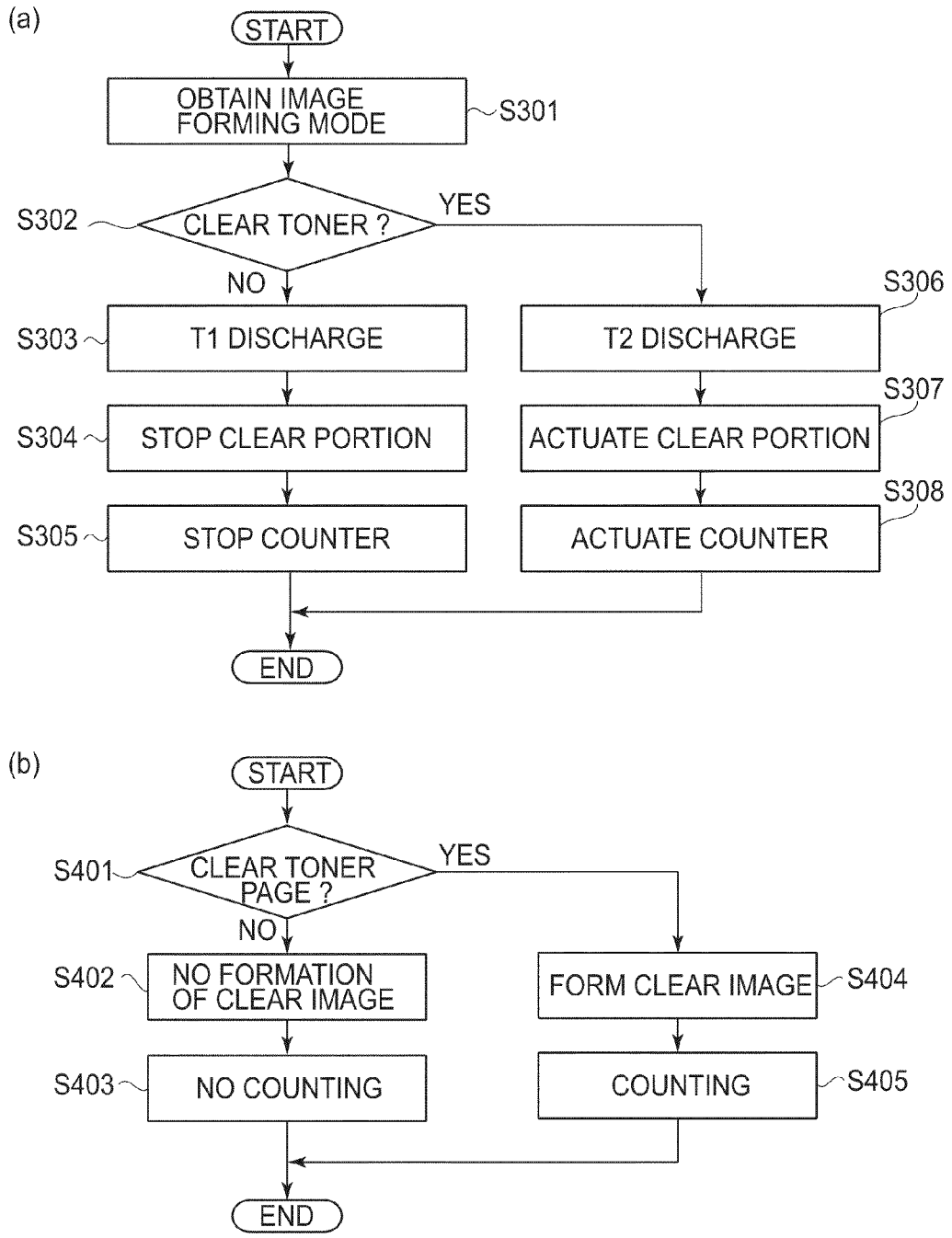
FIGS. 12(*a*) and 12(*b*) are flow charts each for illustrating counting of the number of sheets for image formation in the image forming system.

FIG. 12(*a*) is a flow chart for illustrating the counting method in the case where the mode in which the image is formed with only the color toners is selected and the mode in which the image is formed with the color toners and the transparent toner is selected.

The control portion 500*c* outputs the image while switching the discharging tray depending on the mode selected by the user. The control portion 500*c* as the control means obtains the mode selected by the user (S301). Then, the control portion 500*c* switches the counting method depending on whether or not the selected mode is the mode using the transparent toner (S302). In the case where the user selects the mode in which the image is formed with only the color toners (S302: NO), the control means executes steps S303 to S305. Specifically, the control portion 500*c* switches the flapper f1 so as to discharge the sheet onto the sheet discharging tray T1 (S303). Then, the control portion 500*c* controls the control portion 700*c* through the network so as to stop the operation of the transparent image forming portion 700 (sleep mode) (S304), so that the counter for counting the number of sheets subjected to the transparent toner image formation is not incremented.

Further, in the case where the user selects the mode in which the image is formed with the color toners and the transparent toner (S302: YES), the control means executes steps of S306 to S308. That is, the control means switches the flapper so that the sheet is conveyed toward the transparent image forming apparatus and actuates the transparent image forming portion, so that the counter for counting the number of sheets subjected to the transparent toner image formation is incremented.

As described above, depending on the image forming mode selected by the user, the counting method of counting the number of sheets subjected to the transparent toner image formation. Incidentally, even when the user selects the transparent toner image forming mode, the transparent toner image is not always formed at all of pages in an inputted print job. For that reason, in order to count the number of sheets subjected to the transparent toner image formation with high accuracy, a counting method shown in FIG. 12(*b*).

FIG. 12(*b*) is a flow chart for illustrating the counting method in the case where a job including a page at which the image is formed with the color toners and the transparent toner and a page at which the image is formed with the color toners but is not formed with the transparent toner.

In the case where there as the pages at which the images are formed with the color toners and the transparent toner in one job (i.e., a series of image forming instructions) (hereinafter, referred to as a mixture job), the control portion 500*c* operates the flapper so that the sheet on which the image designated by the job is formed is discharged onto the sheet discharging tray T2. Then, the number of sheets for the pages at which the color toner image and the transparent toner image are formed and the number of sheets for the pages at which only the color toner image is formed are separately counted. In a step S401, the page at which the image is formed is judged as to whether or not the transparent toner is used. In the case where the transparent toner is used at the page (S401: YES), the control means forms the transparent toner image and increments the counter for counting the number of sheets subjected to the transparent toner image formation (S404, S405). On the other hand, in the case where the transparent toner is not used (S401: NO), the control means does not form the transparent toner image and increment the counter (S402, S403).

4. System and Adjusting Process

A problem occurring in the case where the image is formed by the image forming system by using the counting method described above will be described. In the image forming system, a preferred frequency of adjustment is different between the upstream-side image forming apparatus and the downstream-side image forming apparatus. That is, in the case where the apparatuses different in specifications are connected, when the image forming condition is adjusted at a proper frequency of one of the image forming apparatuses, the image forming condition for the other image forming apparatus is adjusted excessively or insufficiently (FIG. 13).

Figure 13:
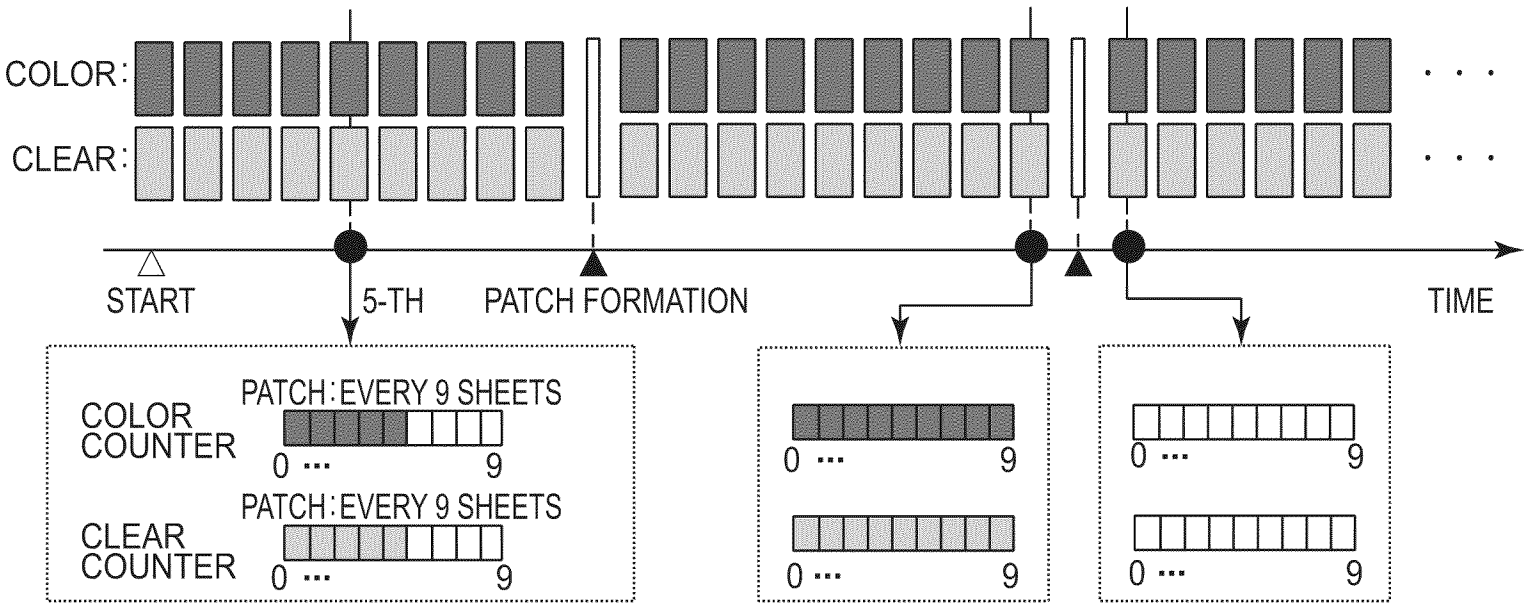
FIGS. 13 to 16 are schematic views each for illustrating patch adjusting timing during continuous image formation.

FIG. 13 is a schematic view for illustrating the case where the counting of the number of sheets subjected to the image formation and the adjustment of the image forming condition by the patch are performed under the same condition with respect to the color toner image and the transparent toner image. Each of rectangular portions at an upper portion of FIG. 13 represents that the color toner image or the transparent toner image is formed on one sheet. In FIG. 13, at all the pages, the color toner image is formed. Similarly, at all the pages, the transparent toner image is formed.

At the 5-th sheet from start of the continuous image formation, the count of each of a color toner sheet counter and a transparent toner sheet counter is five. In FIG. 13, setting is made so that the patch is formed every 9 sheets at each of the color image forming portion and the transparent image forming portion and then the density is adjusted. As described above, the same condition is employed with respect to the frequency of formation of the patch toner image although the preferred adjustment frequency is different between the color image forming portion and the transparent image forming portion, so that such a problem that the transparent toner patch is excessively formed to increase the toner consumption amount occurs.

Figure 14:
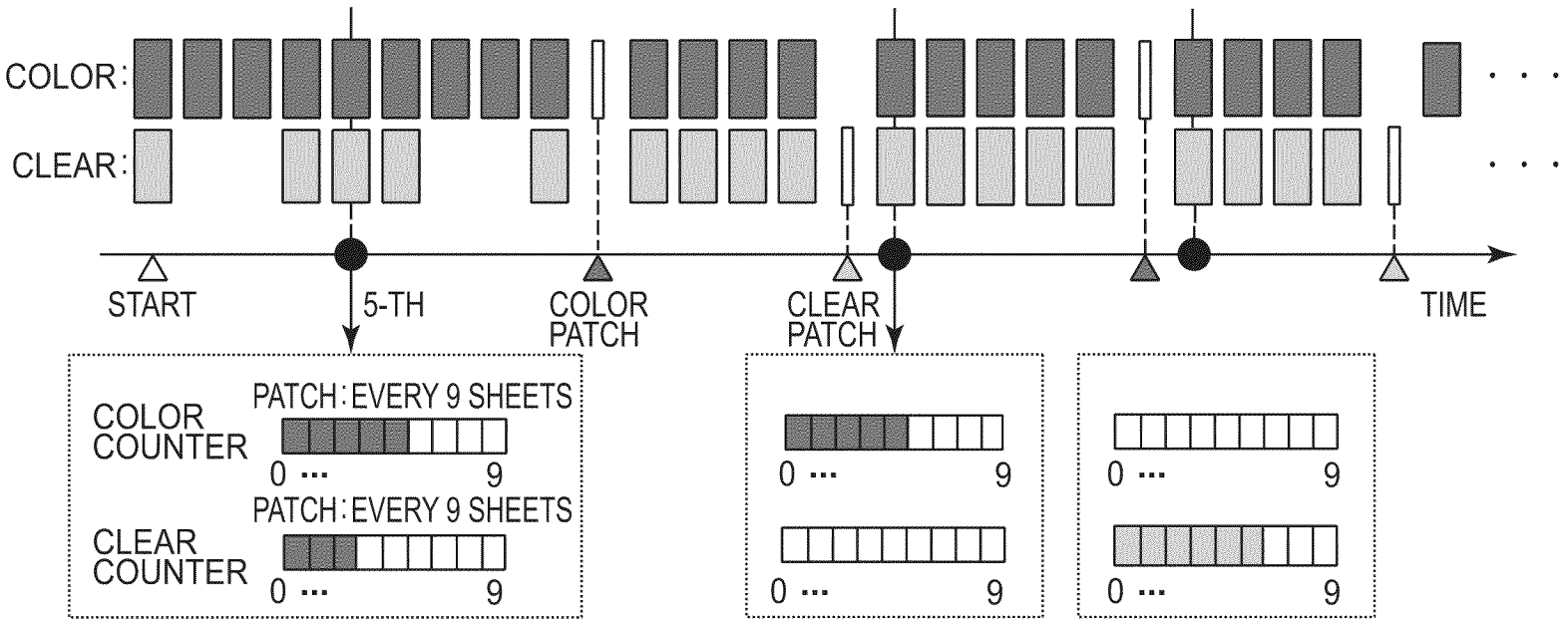

FIG. 14 is a schematic view for illustrating a state in which the adjustment frequency by the patch is extremely increased due to the difference in value between the color toner image counter and the transparent toner sheet counter. In FIG. 14, at the pages on the 2nd sheet and the third sheet from the start of the image formation, the transparent toner image is not formed. For that reason, the counter value when the 5-th sheet is outputted, the color toner sheet counter indicates 5 but the transparent toner sheet counter indicates 3. For that reason, the image forming condition is adjusted by forming the color patch after the 9-th sheet is outputted, and is also adjusted by forming the transparent patch after the 13-th sheet is outputted. Therefore, the adjustment time is increased due to the patch formation, so that a problem of a lowering in productivity occurs.

Figure 15:
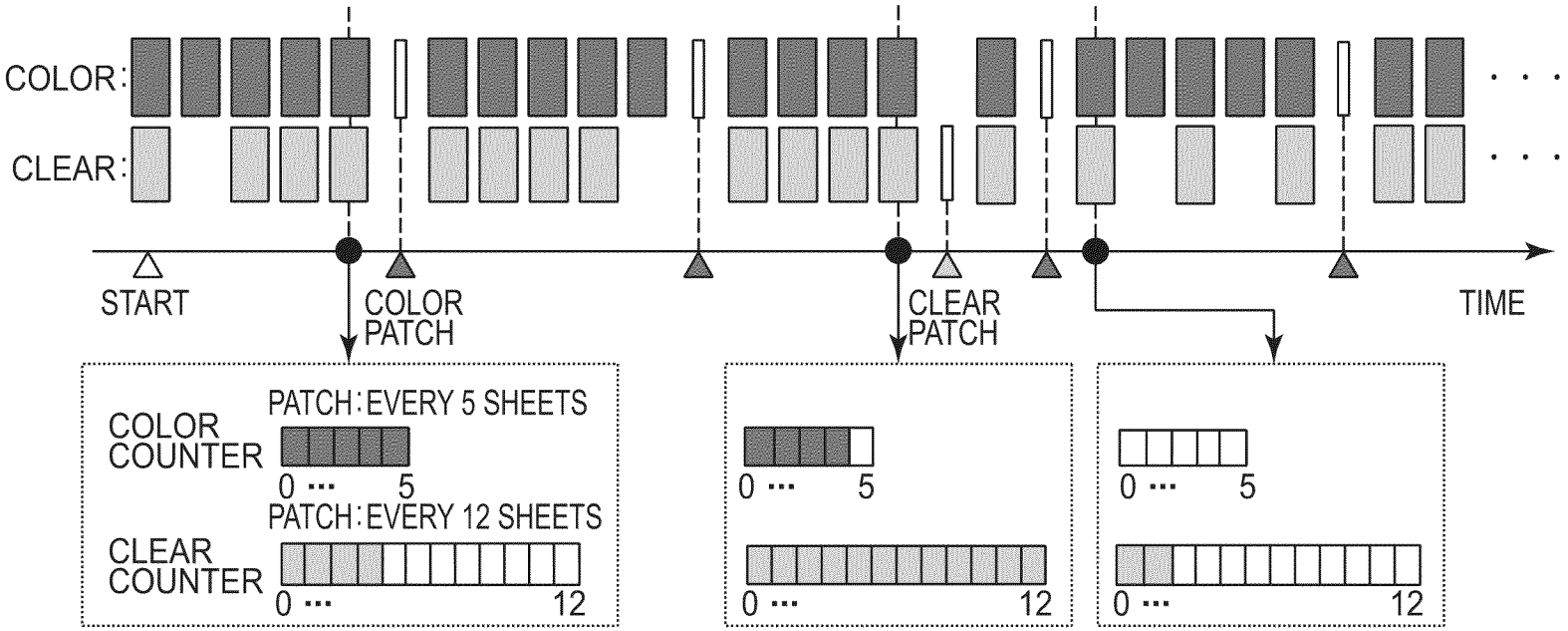

FIG. 15 is a schematic view for illustrating a state in which the frequency of adjustment of the image forming condition for the transparent image forming portion is less than that for the color image forming portion. In this case, the amount of the transparent toner consumed for forming the patch images can be reduced by changing the adjustment frequency but the problem of the lowering in productivity occurs due to an increase in adjustment time by the patch formation.

Figure 16:
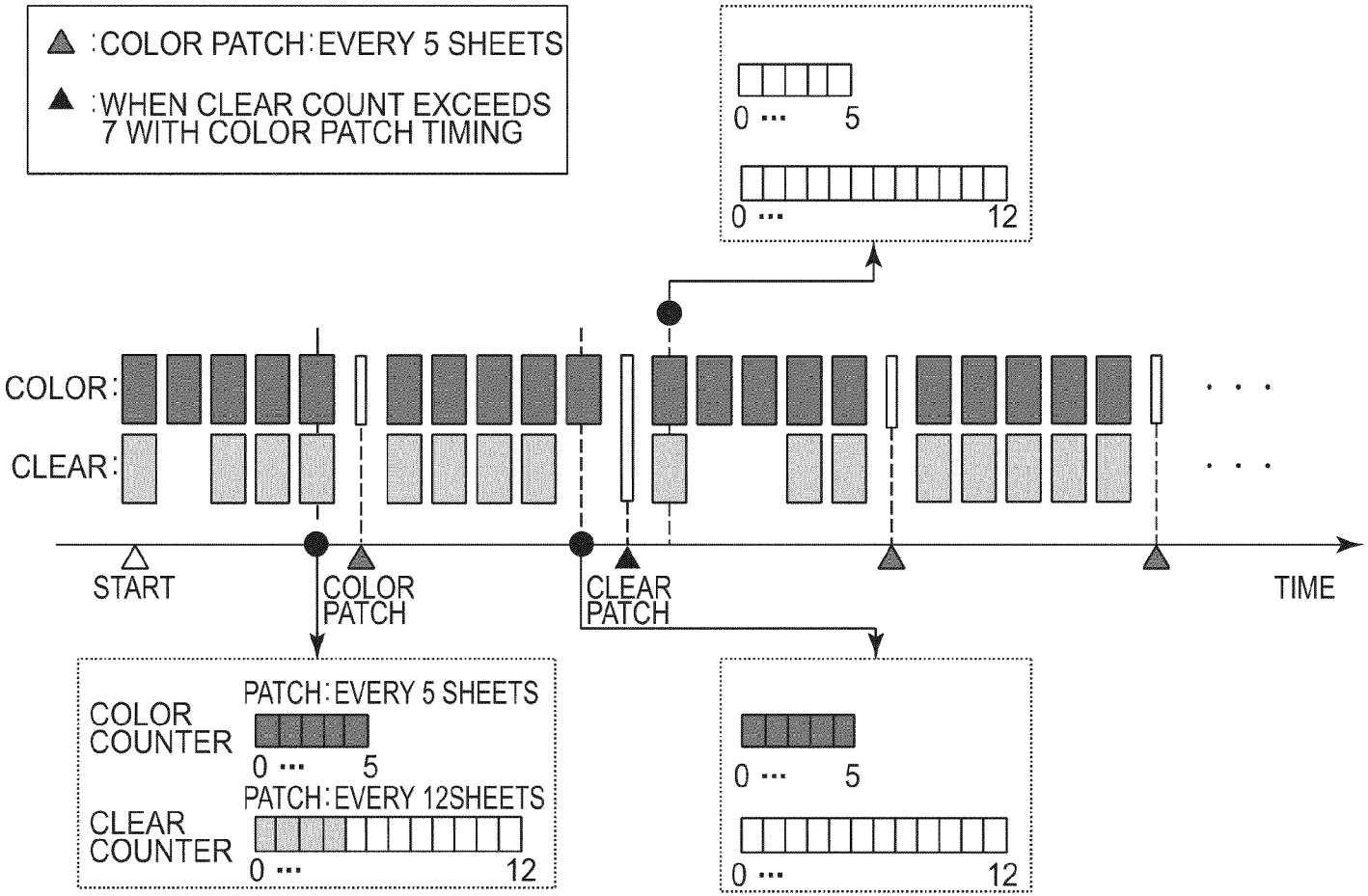

In view of these problems, in this embodiment, by a method as shown in FIG. 16, the transparent toner consumption amount is reduced and the lowering in productivity is suppressed. Specific control will be described along a flow chart shown in FIG. 17 below.

5. Transparent Patch Formation Control Timed to Color Patch Formation

Figure 17:
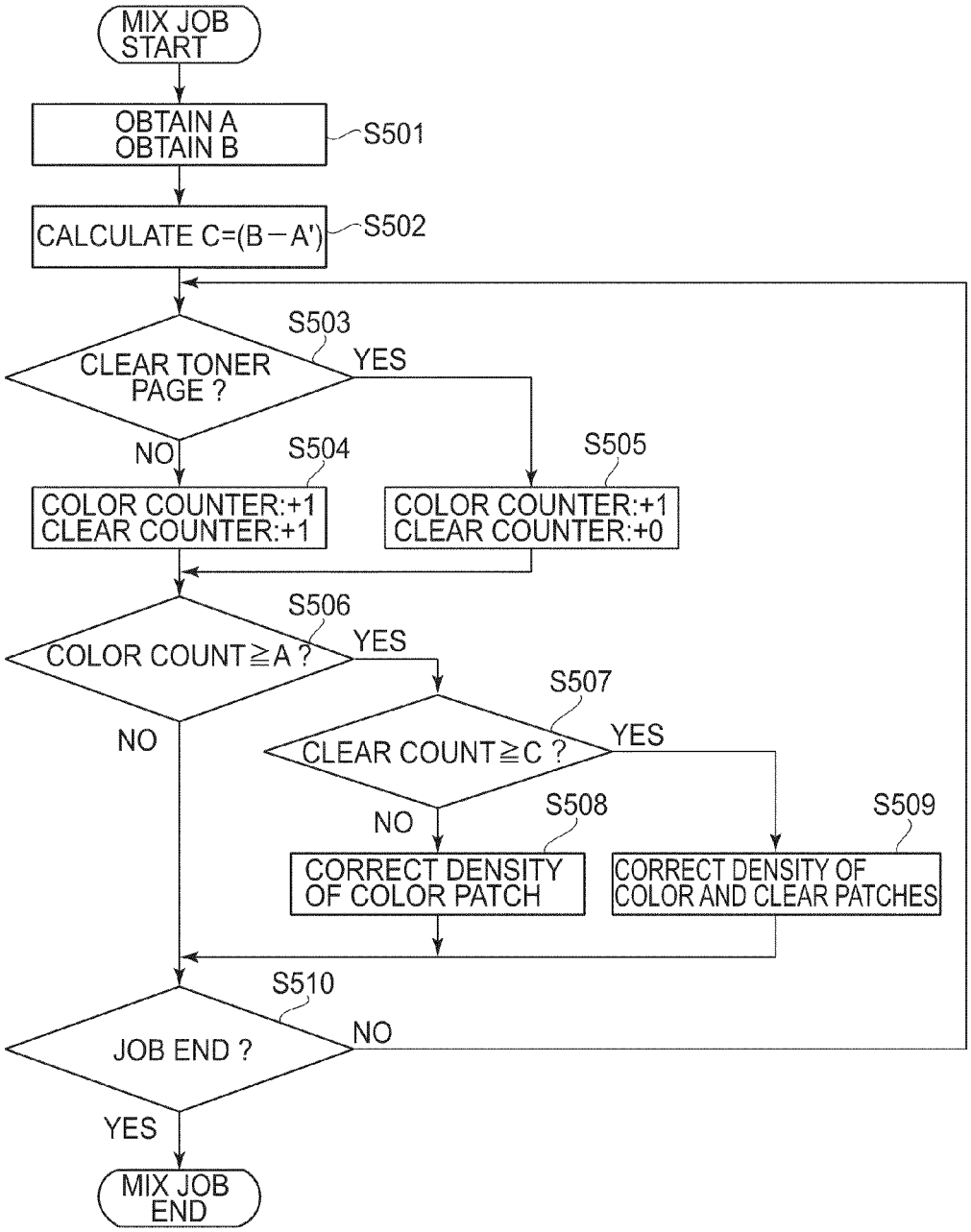
FIG. 17 is a flow chart regarding control of the patch adjusting timing in the image forming system.

FIG. 17 is the flow chart regarding the image adjustment in the image forming system in this embodiment. A program corresponding to the flow chart is stored in a memory and is executed by any one of the control portions in the image forming system.

With respect to each of the image forming apparatuses constituting the image forming system, the image formation frequency depending on the specifications is determined. In this embodiment, a proper image adjustment frequency depending on each image forming apparatus is stored in the memory (storing means) in each image forming apparatus.

The control means for effecting centralized control of the image forming system obtains the image adjustment frequency depending on the specifications of each image forming apparatus stored in each image forming apparatus (S501). Specifically, the control portion 500*c* obtains the number (A) of sheets subjected to color patch operation execution stored in the memory therein and the number (B) of sheets subjected to transparent patch operation execution stored in the memory in the control portion 700*c* (S501). Then, the control portion 500*c* sets again the image adjustment frequency for the image forming apparatus, for which the frequency is set at a lower level, of the image forming apparatuses constituting the image forming system. Specifically, the control portion 500*c* changes the transparent patch formation frequency from every B sheets to every C (=B−A) sheets (S502). Incidentally, there-setting of the adjusting timing of the low frequency apparatus is executed during an actuating sequence of the image forming system and may be stored in the memory. In this embodiment, the transparent patch formation timing may only be required to be timed to the color patch formation. In the case where the transparent toner sheet counter exceeds B sheets, the transparent patch formation may also be effected with the timing of subsequent color patch formation.

Then, the adjusting timing of the image forming system in this embodiment will be described. Each of the counters is updated, depending on whether or not the transparent toner image is formed at each page, by the control portion from the start of the image formation designated by the job. In the case where the image is formed at the page with the color toner and the transparent toner (S503: NO), the transparent toner sheet counter and the color toner sheet counter are incremented (S504). Further, in the case where the image is formed at the page with only the color toner (S503: YES), only the color toner sheet counter is incremented (S505). By increasing the counter in this manner, the amount of the transparent toner used for forming the transparent toner patch can be suppressed.

Next, control of execution timing of the adjusting sequence for adjusting the image forming condition by forming the transparent toner patch and the color toner patch. In the control in this embodiment, the frequency of the transparent toner patch formation is adjusted by being timed to the frequency of the color toner patch formation by the color image forming apparatus. Specifically, the patch is formed on the basis of a value (C) calculated in the step S502. In the case where the value of the color toner sheet counter is not less than A (S506: YES), a step S507 is performed. In the case where the value of the color toner sheet counter is less than A (S506: NO), a step S510 is performed. Further, in the case where the value of the color toner sheet counter is not less than A, proper patch formation is effected in view of the value of the transparent toner sheet counter. That is, the control portion controls the transparent image forming portion so that the transparent toner patch is formed by being timed to the adjustment at the color image forming portion. In the case where the value of the transparent toner sheet counter is not less than C (S507: YES), the color toner patch and the transparent toner patch are formed to adjust the respective image forming conditions (S509). Further, in the case where the value of the transparent toner sheet counter is less than C (S507: NO), only the color toner patch is formed (S508).

The above operations are continued until the image formation designated by the inputted job is ended (S510). As a result, in the image forming system including the image forming apparatuses different in specifications, the reduction in toner consumption and suppression of the lowering in productivity can be realized compatibly.

Incidentally, the transparent toner is used for the purpose of eliminating a difference between the glossiness at the image portion and the glossiness at the non-image portion to achieve uniform glossiness. Further, in addition, the transparent toner is used for the purpose of alleviating a difference between projected portion and recessed portion of the surface of the recording material such as transfer paper or recording paper by placing the transparent toner on the recessed portion of the recording material surface to generate the gloss, so that the glossiness of the whole image is improved. Further, in the case where the recording material is bent or abraded, the transparent toner is also used for the purpose of preventing an occurrence of cracking or breaking of the toner image melt-fixed on the recording material. These purposes can also be achieved by white toner in addition to the transparent toner, i.e., by colorless toner such as the transparent toner or the white toner. Therefore, in this embodiment, there is no problem even when the white toner is used in place of the transparent toner.

The transparent toner means toner particles containing no colorant (such as coloring pigment, coloring dye, carbon black particles or black magnetic powder) for the purpose of coloring the toner by light absorption or light scattering and at least contains a binder resin. Further, the transparent toner is generally colorless and transparent but can be lowered in transparency depending on the type or the amount of a fluidizing agent or a parting agent. In this case, however, the resultant transparent toner is substantially colorless or transparent. The binder resin may only be required to be substantially transparent and can be appropriately selected depending on the purpose. For example, as the binder resin, polyester resin, polystyrene-based resin or polyacrylic resin may generally be used. It is also possible to use other known resins used for general-purpose toner, such as vinyl resin, polycarbonate resin, polyamide resin, polyimide resin, epoxy resin or polyurea resin and to use copolymers or these resins. Of these materials, the polyester resin may preferably be used from the viewpoint that it can simultaneously satisfy toner characteristics such as low-temperature fixability, fixation strength and storage property.

The present invention is described above based on specific embodiments but is not limited to the embodiments described above. For example, there has been an image forming apparatus in which a rotatable belt-like recording material carrying member, i.e., a conveyer belt is provided as the recording material carrying member for carrying and conveying the recording material while being opposed to the image forming portions and images formed at the image forming portions are successively transferred onto the recording material carried on the conveyer belt. In the image forming apparatus, similarly as in a manner in which the test toner images are formed on the surface of the intermediary transfer belt in the embodiments described above, the test toner images are formed on the surface of the conveyer belt and are optically detected to effect the image density correction control. In this case, the conveyer belt functions as the image bearing member but even in such an image forming apparatus, there arises a problem similar to that of the image forming apparatus using the intermediary transfer belt as in the above-described embodiments. Therefore, also in such an image forming apparatus, it is possible to achieve an effect similar to that in the above-described embodiments.

Further, there has also been an image forming apparatus which includes a single photosensitive drum and plural developing devices and which is configured to superposedly transfer the toner images, formed successively on the photosensitive drum with the toners different in color, onto the intermediary transfer member or the recording material on the recording material carrying member. In such an image forming apparatus, the transparent toners are formed on the photosensitive drum as the image bearing member and then are optically detected to effect the image density correction control. Also in such an image forming apparatus, with respect to formation of the test toner images on the photosensitive drum, problems such as the increase in down time and the increase in toner consumption amount can occur similarly as in the case of forming the test toner images on the intermediary transfer belt in the above-described embodiments. Therefore, by applying the present invention to such an image forming apparatus, an effect similar to that in the embodiments described above can be achieved. Incidentally, in such an image forming apparatus, the color toner image forming means is constituted by the charging means, the exposure means, the developing device and the like for forming the color toner image on the photosensitive drum as the image bearing member. Further, the transparent toner image forming means is constituted by the charging means, the exposure means, the developing device and the like for forming the transparent toner image on the photosensitive drum as the image bearing member. Some means such as the charging means, the exposure means and the like for the color toner image forming means may also be common to those for the transparent toner image forming means.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 266650/2009 filed Nov. 24, 2009, which is hereby incorporated by reference.

What is claimed is:

1. An image forming apparatus comprising:

a plurality of color image forming stations including a yellow image forming station configured to form a yellow toner image, a magenta image forming station configured to form a magenta toner image, a cyan image forming station configured to form a cyan toner image, and a black image forming station configured to form a black toner image;

a transparent image forming station configured to form a transparent toner image;

a transfer station configured to transfer the yellow toner image, the magenta toner image, the cyan toner image, the black toner image and the transparent toner image, which are formed by said color image forming stations and said transparent image forming station, respectively, to a sheet;

a detector configured to optically detect a density of each of a test yellow toner image, a test magenta toner image, a test cyan toner image, a test black toner image and a test transparent toner image which are formed by said color image forming stations and said transparent image forming station, respectively;

a controller configured to control each image forming condition of said color image forming stations and said transparent image forming station on the basis of an associated density detected by said detector; and a counter configured to count a number of sheets on which an image forming process was performed in said apparatus, wherein said controller controls said color image forming stations to form the test yellow toner image, the test magenta toner image, the test cyan toner image and the test black toner image when the number of the sheets counted by said counter reaches a first value, and controls said transparent image forming station to form the test transparent toner image when the number of the sheets counted by said counter reaches a second value which is greater than the first value.

2. The image forming apparatus according to claim 1, wherein said transfer station includes an intermediate transfer member, a primary transfer device configured to primarily transfer the yellow toner image, the magenta toner image, the cyan toner image, the black toner image and the transparent toner image from said color image forming stations and said transparent image forming station to said intermediate transfer member, and a secondary transfer device configured to secondarily transfer the yellow toner image, the magenta toner image, the cyan toner image, the black toner image and the transparent toner image from said intermediate transfer member to the sheet, and wherein said detector detects the density of each of the test yellow toner image, the test magenta toner image, the test cyan toner image, the test black toner image and the test transparent toner image on said intermediate transfer member.

3. The image forming apparatus according to claim 2, wherein each of said color image forming stations and said transparent image forming station includes a photosensitive member, an electrostatic latent image forming device configured to form an electrostatic latent image on said photosensitive member and a developing device configured to develop the electrostatic latent image using toner, wherein each of said photosensitive members is provided so as to contact said intermediate transfer member during a primary transfer process.

* * * * *